US008912473B2

(12) United States Patent
Roux

(10) Patent No.: US 8,912,473 B2
(45) Date of Patent: Dec. 16, 2014

(54) VARIABLE-SIZE INDUCTION HEATING PLATE

(75) Inventor: Alain Roux, Saint-Hilaire-Saint-Mesmin (FR)

(73) Assignee: Fagorbrandt SAS, Rueil-Malmaison (FR)

( * ) Notice: Subject to any disclaimer, the term of this patent is extended or adjusted under 35 U.S.C. 154(b) by 1208 days.

(21) Appl. No.: 12/159,208

(22) PCT Filed: Dec. 22, 2006

(86) PCT No.: PCT/FR2006/002853

§ 371 (c)(1), (2), (4) Date: Jun. 26, 2008

(87) PCT Pub. No.: WO2007/074233

PCT Pub. Date: Jul. 5, 2007

(65) Prior Publication Data

US 2009/0008384 A1 Jan. 8, 2009

(30) Foreign Application Priority Data

Dec. 27, 2005 (FR) ..... 05 13362

(51) Int. Cl.
*H05B 6/36* (2006.01)
*H05B 6/06* (2006.01)

(52) U.S. Cl.
CPC ..... *H05B 6/062* (2013.01); *H05B 2213/03* (2013.01); *H05B 2213/05* (2013.01)
USPC ..... 219/672

(58) Field of Classification Search
CPC . H05B 6/062; H05B 2213/03; H05B 2213/05
USPC ..... 219/443.1–468.2, 518, 620–627, 219/660–672
See application file for complete search history.

(56) References Cited

U.S. PATENT DOCUMENTS 4,074,101 A * 2/1978 Kiuchi et al. ..... 219/601
4,987,828 A * 1/1991 Nuns et al. ..... 99/443 C (Continued)

FOREIGN PATENT DOCUMENTS

FR 2 758 994 8/1998
FR 2 863 039 A 6/2005
WO WO 2005/064992 A1 * 7/2005 ..... H05B 6/06

OTHER PUBLICATIONS

Machine Translation of WO 2005/064992 A1 Description.*

(Continued)

*Primary Examiner* — Henry Yuen
*Assistant Examiner* — Eric Stapleton
(74) *Attorney, Agent, or Firm* — Young & Thompson

(57) ABSTRACT

A variable-size induction heating plate includes a plurality of windings (10*a*, 10*b*, 10*c*, 10'*a*, 10'*b*, 10'*c*) arranged in a cooking surface. The heating plate includes two sets (10, 10') of a plurality of windings arranged side-by-side, each set (10, 10') of windings being adapted in such a way as to form a heating plate, and control elements (12, 12', 13) which are adapted in such a way as to control the operation of the sets (10, 10') both in an independent manner and a synchronous manner. Each set of windings is fed by a single current generator (11, 11). The inventive heating plate can be used in an induction cooking surface.

23 Claims, 2 Drawing Sheets

(56) References Cited

U.S. PATENT DOCUMENTS

| | | | | |
|---|---|---|---|---|
| 5,136,277 | A * | 8/1992 | Civanelli et al. | 340/568.1 |
| 5,658,478 | A * | 8/1997 | Roeschel et al. | 219/502 |
| 5,808,280 | A * | 9/1998 | Gaspard | 219/624 |
| 5,893,996 | A * | 4/1999 | Gross et al. | 219/447.1 |
| 5,900,174 | A * | 5/1999 | Scott | 219/447.1 |
| 6,184,501 | B1 * | 2/2001 | Zapf | 219/447.1 |
| 6,232,731 | B1 * | 5/2001 | Chapman | 318/801 |
| 6,259,069 | B1 * | 7/2001 | Schotten et al. | 219/447.1 |
| 6,263,782 | B1 * | 7/2001 | Brindani et al. | 99/331 |
| 6,528,770 | B1 * | 3/2003 | Akel et al. | 219/624 |
| 6,614,006 | B2 * | 9/2003 | Pastore et al. | 219/447.1 |
| 6,633,023 | B2 * | 10/2003 | Cornec et al. | 219/624 |
| 7,202,451 | B2 * | 4/2007 | Uchida et al. | 219/662 |
| 7,361,870 | B2 * | 4/2008 | Cornec et al. | 219/660 |
| 7,423,244 | B2 * | 9/2008 | Baier et al. | 219/624 |
| 7,425,690 | B2 * | 9/2008 | Schilling | 219/451.1 |
| 7,759,616 | B2 * | 7/2010 | Gouardo et al. | 219/445.1 |
| 2001/0025848 | A1 * | 10/2001 | Cornec et al. | 219/624 |
| 2002/0053563 | A1 * | 5/2002 | Pastore et al. | 219/448.11 |
| 2003/0071031 | A1 * | 4/2003 | Gerola et al. | 219/462.1 |
| 2004/0238524 | A1 * | 12/2004 | Lerner | 219/445.1 |
| 2005/0199614 | A1 * | 9/2005 | Uchida et al. | 219/662 |
| 2007/0164017 | A1 * | 7/2007 | Gouardo et al. | 219/626 |

OTHER PUBLICATIONS

Machine Translation of WO 2005/064992 A1 Claims.*

* cited by examiner

VARIABLE-SIZE INDUCTION HEATING PLATE

BACKGROUND OF THE INVENTION

1.Field of the Invention

The present invention concerns a variable-size induction heating plate, and an induction cooking surface integrating such a plate.

2. Description of the Related Art

The present invention applies generally to the field of domestic induction cooking appliances, such as induction vitroceramic cooking surfaces.

An induction heating plate generally consists of a circular winding adapted to the dimension of a cooking vessel of given size.

It can equally consist of a plurality of concentric windings enabling adaptation to different diameters of vessels disposed on the cooking surface above the plate.

A heating plate can equally consist of a plurality of windings disposed side by side and supplied with power by independent generators, as described in patent application FR 2 758 994.

Also known are cooking surfaces comprising a plurality of small windings disposed in a cooking surface. One such cooking surface is described in the document FR 2 863 039 in particular. That document describes a set of circular windings disposed side by side so as to cover all of the area of the cooking surface. In this kind of set, the windings are magnetically independent and are controlled independently so that each heating plate is determined individually as a function of the position of the vessel on the cooking surface, facing the windings.

However, as a function of the position of the vessel on the cooking surface, it is not rare for a significant proportion of a group of windings not to be covered by the vessel, with the result that the power delivered by the induction winding is low.

The power delivered, by a particular heating plate depends on the electromagnetic matching between the induction winding and the vessel disposed above it. The vessel is seen as a resistive load by the current generator feeding the induction winding. In principle, induction heating devices are designed to optimize the electromagnetic matching and to maximize the power delivered when the vessel completely covers the area of the induction winding.

SUMMARY OF THE INVENTION

An object of the present invention is to resolve the drawbacks cited above and to propose a variable-size induction heating plate guaranteeing delivery of high power to a vessel regardless of its size.

To this effect the present invention concerns a variable-size induction heating plate comprising at least two sets of a plurality of windings disposed side by side in a plane, each set of a plurality of windings being adapted to constitute a heating plate.

According to the invention, the heating plate comprises control means adapted on the one hand to control said sets for independent operation and on the other hand to control said sets for synchronous operation, each set being supplied with power by a single current generator.

Thus the induction heating plate has the advantage of being able to function as two medium-size independent heating plates or as a single, larger plate.

By using a plurality of windings in each set constituting a heating plate, the overlapping proportion of the induction windings is very high when a vessel is placed on both sets.

According to one advantageous feature of the invention, the sets include exactly the same number of windings.

The windings of each set are preferably tangential to a circle corresponding to the dimension of the heating plate associated with that set, well adapted to the circular shape of a standard cooking vessel.

Further, each set includes at least three equidistant windings, enabling good distribution in the plane of the heating plate of the area covered by the induction windings facing the bottom of a vessel.

Thanks to this equidistant disposition of the windings, the bottom of a vessel placed on three equidistant windings achieves an overlap of greater than 70%.

One embodiment of the heating plate includes two sets, each set including at least three equidistant windings, at least two windings of a first set being disposed face to face with at least two respective windings of a second set.

This arrangement produces a heating plate wider at its center, well suited to heating larger vessels when the sets of windings function in synchronized mode.

Moreover, the area of the induction windings covered by a vessel placed, at the center of the two sets is greater than 50% with a vessel of a size such that it completely covers a set of induction windings. Moreover, the area of the bottom of a vessel facing the windings of a set represents at least 70% of the total area of the bottom of the vessel.

The windings of each set are preferably tangential to an ellipse corresponding to the dimension of a single large heating plate.

The present invention also concerns an induction cooking surface comprising a heating plate according to the invention.

That cooking surface has features and advantages analogous to those described previously in relation to the heating plate.

Other features and advantages of the invention will become more apparent in the course of the following description.

DETAILED DESCRIPTION OF THE DRAWING FIGURES

In the appended drawings, which are provided by way of nonlimiting example.

DETAILED DESCRIPTION OF THE INVENTION

One embodiment of an induction heading plate of the invention is described next with reference to FIGS. 1 to 4.

In this embodiment, the heating plate comprises two sets 10, 10' of a plurality of windings 10*a*, 10*b*, 10*c*, 10'*a*, 10'*b* and 10'*c*, all disposed in a plane parallel to the cooking surface.

Figure 2:
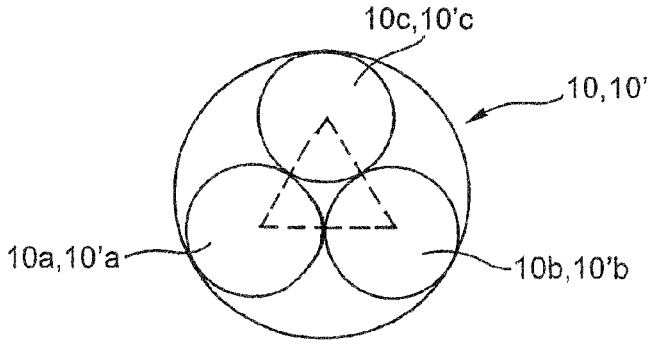
FIG. 2 is a diagram showing a set of windings of the FIG. 1 heating plate.

As shown clearly in FIG. 2, each set 10, 10' includes three windings disposed in a triangle so that each set 10, 10' includes windings equidistant from each other.

Thus each set 10, 10' of three windings is inscribed in a circle, as shown in FIG. 2, in such a manner as to constitute a disc-shaped heating plate particularly suitable for the shape of a cooking vessel.

In this embodiment, the windings are disc-shaped and tangential to the circle defining the heating plate.

Each winding consists of an electrically conductive coil.

In practice, each winding can consist of a flat, spiral coil of multistrand copper wires.

The electrically conductive coils of each winding are not parallel to the electrically conducting coils of the adjacent windings. There is therefore virtually no inherent magnetic coupling between two adjacent windings.

Moreover, the two sets of windings are disposed side by side in a plane parallel to the cooking surface and are substantially inscribed in an oval or elliptical shape.

In practice, each set 10, 10' includes two equidistant windings 10*a*, 10*b* and 10'*a*, 10'*b* facing each other.

Figure 1:
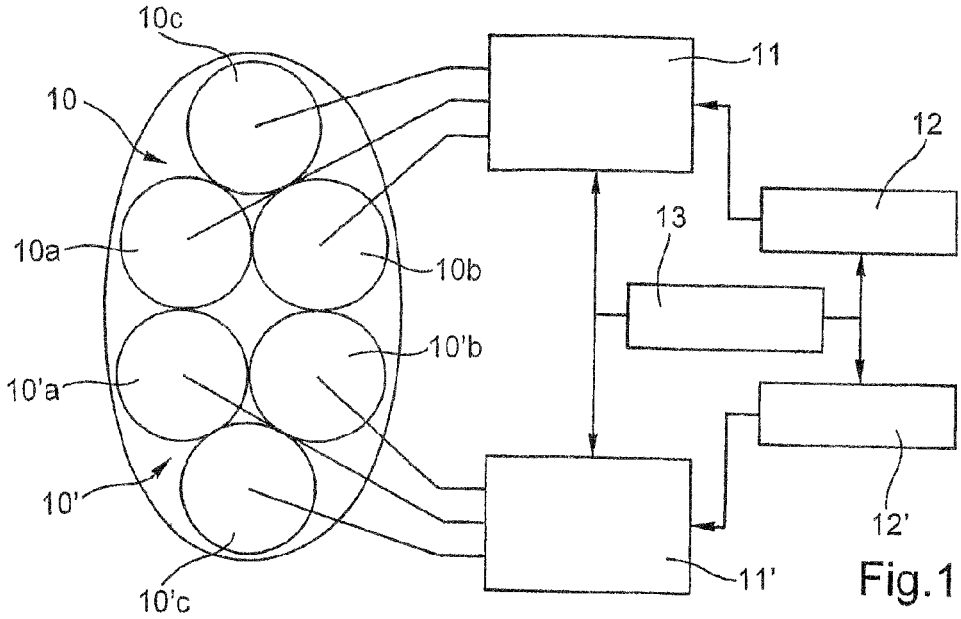
FIG. 1 is a simplified diagram showing an induction heating plate conforming to one embodiment of the present invention.

As shown in FIG. 1, each set 10, 10' is supplied with power by a single high-frequency alternating current generator 11, 11' used in the conventional manner to supply power to induction heating windings. The three windings of each set 10, 10' are electrically connected in series or in parallel to each generator 11, 11'.

The windings of each set 10, 10' are preferably electrically connected in series to each generator 11, 11'. Thus, in contrast to a parallel circuit, it is possible to prevent overheating of a winding not covered by a small vessel placed on the set.

Control means 12, 12' provide for operation in two configurations.

Figure 3:
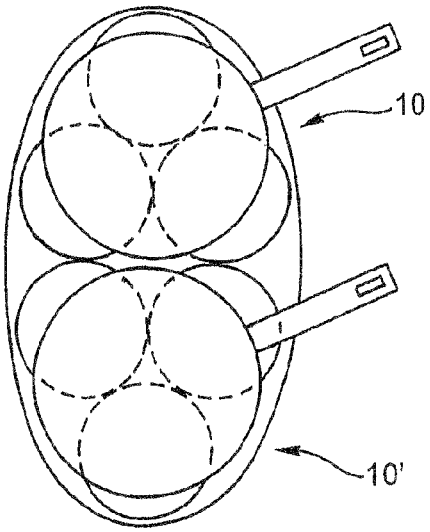
FIG. 3 is a diagram showing the operation of the FIG. 1 heating plate as two separate plates.

If the heating plates consisting of each set 10, 10' are used independently, as shown in FIG. 3, for example, the control means 12, 12' are adapted to control the operation of each generator 11, 11' independently, thus ensuring independent operation of the two heating plates.

Figure 4:
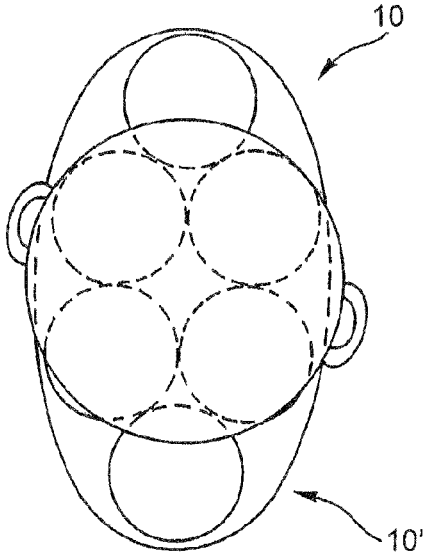
FIG. 4 is a diagram showing the operation of the FIG. 1 heating plate as a single plate.

On the other hand, if the heating plate is used as a single plate for heating a larger vessel, as shown in FIG. 4, the control means 12, 12' are adapted to control the operation of the generators 11, 11' synchronously, by means of a synchronization module 13, to enable synchronous operation of the six windings 10*a*, 10*b*, 10*c*, 10'*a*, 10'*b* and 10'*c*.

In practice, and by way of nonlimiting example, the diameter of each induction winding 10*a*, 10*b*, 10*c*, 10'*a*, 10'*b*, 10'*c* is approximately 100 mm. Each set 10, 10' of three windings disposed in a triangle is then inscribed in a circle of approximately 200 mm, which corresponds to a plate of average size.

The juxtaposition of two sets 10, 10' in two triangular arrangements facing in opposite directions produces a cooking area approximately 200 mm wide and 400 mm long.

The variable-size heating plate therefore offers the possibility of using two independent heating plates each consisting of three windings of each set 10, 10' , a central circular plate of medium size consisting of four windings 10*a*, 10*b*, 10'*a*, 10'*b* controlled synchronously, or a large elliptical plate consisting of the six windings 10*a*, 10*b*, 10*c*, 10'*a*, 10'*b*, 10'*c* controlled synchronously.

Thus a variable-size heating plate of this kind accepts, on the one hand, one or two small vessels, of the order of 12 to 20 cm diameter, disposed side by side, and, on the other hand, a vessel of medium size, of the order of 25 cm diameter, or a large oval vessel, up to 40 cm long.

As shown clearly in FIG. 4, thanks to the use of individual windings in each set 10, 10' , a vessel of medium size disposed at the center of the heating plate covers approximately 60% of the area of the induction windings.

It will be noted that if each set 10, 10' were replaced by a single circular induction winding with a diameter substantially equal to 200 mm, the same vessel would cover only approximately 40% of the area of the induction windings.

Thus the induction heating plate of the invention optimizes the area of the induction windings covered by a vessel whatever its size, and thus guarantees a high power in operation for the various uses of the heating plate.

Moreover, it is important that the total area covered by the induction windings disposed under the bottom of the vessel be as large as possible to guarantee a good distribution of temperature in the vessel.

Using small individual windings, it is possible to improve the distribution of the area of the windings facing the bottom of the vessel, and thus to guarantee a good distribution of heat in the vessel.

Thus, thanks to the triangular arrangement of three windings under the bottom of a vessel whose diameter substantially corresponds to the dimension of the circle tangential to the three windings, more than 70% of the bottom of the vessel overlaps the induction windings.

The shape and the number of windings of each set of the variable-size heating plate are not limited, of course.

Figure 5:
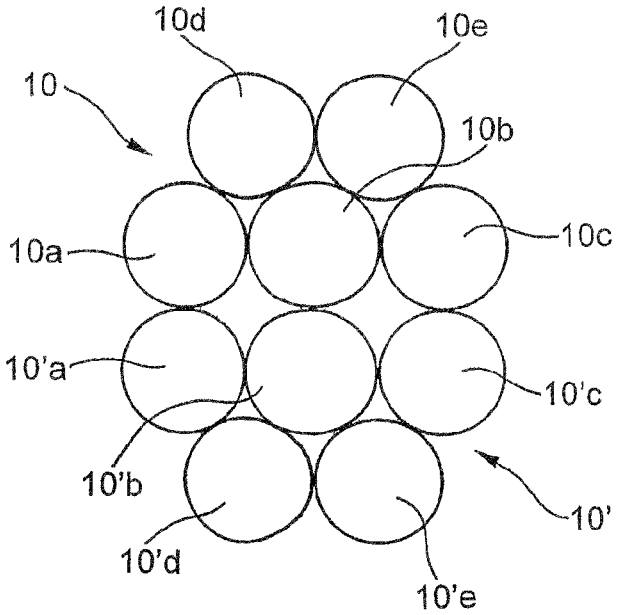
FIGS. 5 and 6 are diagrams showing induction heating plates conforming to other embodiments of the invention.
Figure 6:
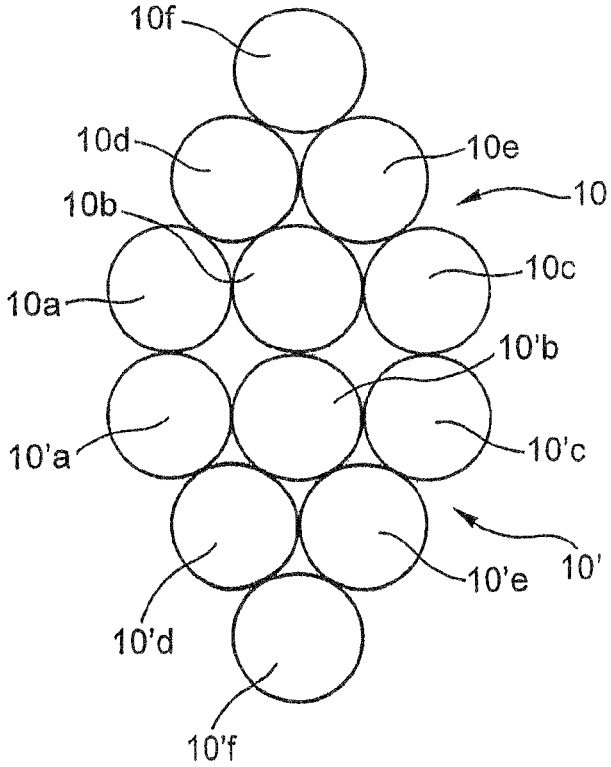

Other examples of heating plates of the invention are shown by way of nonlimiting example in FIGS. 5 and 6, in which the adjacent windings of each set are also interleaved and disposed in a quincunx arrangement relative to each other.

Thus, in FIG. 5, each set 10, 10' includes five respective windings 10*a*-10*e*, 10'*a*-10'*e*. In each set 10, 10', the induction windings are disposed in a quincunx arrangement in two rows. Moreover, each set 10, 10' includes three equidistant windings 10*a*, 10*b*, 10*c* and 10'*a*, 10'*b*, 10'*c* disposed face to face.

As shown in FIG. 6, in another embodiment, each set 10, 10' includes six windings 10*a*-10*f*, 10'*a*-10'*f*. In each set 10, 10', the windings are disposed in a quincunx arrangement and form a basic triangle consisting of three windings 10*a*, 10*b*, 10*c* and 10'*a*, 10'*b*, 10'*c* and having a single winding 10*f*, 10'*f* at the apex.

Plates of variable size and variable shape, for example round, oval or other shape, can be obtained in this way.

There is obtained in this way a heating plate of variable size for use in an induction cooking surface having great flexibility of use as a function of the size of the cooking vessels.

The present invention is not limited to the embodiments described above, of course.

Thus the heating plate could include sets of windings different from each other.

Moreover, the heating plate could include a greater number of sets of windings, for example three sets.

Finally, the shape of the windings is not limited to a disc shape, and can be different, for example oval or another shape.

The invention claimed is:

1. A variable-size induction heating plate comprising:

at least two sets of a plurality of windings disposed side by side in a plane, the windings of each set being electrically connected in series to each generator, the at least two sets including a first set constituting a first heating section, all the windings of said first set being tangential to a circle corresponding to a first heating plate, said first set being supplied with power from a first single current generator, and a second set constituting a second heating section, all the windings of said second set being tangential to a circle corresponding to a second heating plate, said second set being supplied with power from a second single current generator;

a first controller adapted to independently control said first set; and a second controller adapted to independently control said second set, the first and second controllers being adapted to control said first set and said second set in synchronous operation upon said first and second sets constituting a single heating plate, all the windings of said first set and said second set being tangential to an ellipse corresponding to said single heating plate.

2. The heating plate according to claim 1, wherein said sets include exactly a same number of windings.

3. The heating plate according to claim 1, wherein the windings of each set are tangential to a circle corresponding to a circular outer periphery of at least three windings.

4. The heating plate according to claim 1, wherein each set includes at least three equidistant windings.

5. The heating plate according to claim 1, wherein each set including at least three equidistant windings, at least two windings of the first set being disposed face to face with at least two respective windings of the second set.

6. The heating plate according to claim 1, wherein the windings of each set are tangential to an ellipse corresponding to a single large heating plate.

7. The heating plate according to claim 1, wherein the heating plate is disposed on a plane parallel to an induction cooking surface.

8. The heating plate according to claim 2, wherein the windings of each set are tangential to a circle corresponding to a circular outer periphery of at least three windings.

9. The heating plate according to claim 2, wherein each set includes at least three equidistant windings.

10. The heating plate according to claim 3, wherein each set includes at least three equidistant windings.

11. The heating plate according to claim 2, wherein each set including at least three equidistant windings, at least two windings of the first set being disposed face to face with at least two respective windings of the second set.

12. The heating plate according to claim 3, wherein each set including at least three equidistant windings, at least two windings of the first set being disposed face to face with at least two respective windings of the second set.

13. The heating plate according to claim 4, wherein each set including at least three equidistant windings, at least two windings of the first set being disposed face to face with at least two respective windings of the second set.

14. The variable-size induction heating plate according to claim 1, further comprising:

a synchronization module interposed between the first and second control means, the synchronization module controls the synchronous operation of the first and second control means.

15. A variable-size induction heating plate comprising:

at least two sets of a plurality of windings disposed side by side in a plane, the windings of each set being electrically connected in series to each generator, the at least two sets including a first set constituting a first heating section, all the windings of said first set being tangential to a circle corresponding to a first heating plate suitable for a circular cooking vessel, said first set being supplied with power from a first single current generator, and a second set constituting a second heating section, all the windings of said second set being tangential to a circle corresponding to a second heating plate suitable for a circular cooking vessel, said second set being supplied with power from a second single current generator; and a first controller adapted to independently control said first set and a second controller adapted to independently control said second set, the first and second controllers being adapted to control said first set and said second set in synchronous operation upon said first and second sets constituting a single heating plate, all the windings of said first set and said second set being tangential to an ellipse corresponding to said single heating plate suitable for an oval cooking vessel.

16. The heating plate according to claim 15, wherein the windings of each set are tangential to a circle corresponding to a circular outer periphery of at least three windings.

17. The heating plate according to claim 15, wherein each set includes at least three equidistant windings.

18. The heating plate according to claim 15, wherein said sets include exactly a same number of windings.

19. A variable-size induction heating plate comprising:

at least two sets of a plurality of windings disposed side by side in a plane, the windings of each set being electrically connected in series to each generator, the at least two sets including a first set constituting a first heating section, the windings of said first set being disposed in a quincunx arrangement, said first set being supplied with power from a first single current generator, and a second set constituting a second heating section, the windings of said second set being disposed in a quincunx arrangement, said second set being supplied with power from a second single current generator; and a first controller adapted to independently control said first set and a second controller adapted to independently control said second set, the first and second controllers being adapted to control said first set and said second set in synchronous operation upon said first and second sets constituting a single heating plate, two windings of said first set being disposed respectively face to face with two windings of said second set.

20. The variable-size induction heating plate according to claim 19, wherein each set includes five respective windings.

21. The variable-size induction heating plate according to claim 19, wherein in each set the induction wirings are disposed in the quincunx arrangement in two rows.

22. The variable-size induction heating plate according to claim 19, wherein each set includes three equidistant wirings disposed face to face.

23. A variable-size induction heating plate comprising:

at least two sets of a plurality of windings disposed side by side in a plane, the windings of each set being electrically connected in series to each generator, the at least two sets including a first set constituting a first heating section, the windings of said first set being disposed in a quincunx arrangement, said first set being supplied with power from a first single current generator, and a second set constituting a second heating section, the windings of said second set being disposed in a quincunx arrangement, said second set being supplied with power from a second single current generator; and a first controller adapted to independently control said first set and a second controller adapted to independently control said second set, the first and second controllers being adapted to control said first set and said second set in synchronous operation upon said first and second sets constituting a single heating plate, and each set includes six windings, and each quincunx arrangement forms a basic triangle of three windings having a single winding at an apex.

* * * * *